US011815858B2

(12) United States Patent
Hosobuchi

(10) Patent No.: US 11,815,858 B2
(45) Date of Patent: Nov. 14, 2023

(54) SWITCH DEVICE AND TIMEPIECE

(71) Applicant: CASIO COMPUTER CO., LTD., Tokyo (JP)

(72) Inventor: Hiroyuki Hosobuchi, Iruma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 1016 days.

(21) Appl. No.: 16/699,875

(22) Filed: Dec. 2, 2019

(65) Prior Publication Data

US 2020/0174426 A1 Jun. 4, 2020

(30) Foreign Application Priority Data

Dec. 3, 2018 (JP) ..... JP2018-226331

(51) Int. Cl.
*G04B 37/06* (2006.01)

(52) U.S. Cl.
CPC ..... *G04B 37/062* (2013.01)

(58) Field of Classification Search
CPC .... G04B 37/06; G04B 37/062; G04B 37/064; G04B 37/10; G04B 37/106
See application file for complete search history.

(56) References Cited

U.S. PATENT DOCUMENTS 4,415,277 A * 11/1983 Ganter ..... G04B 27/00 368/190
5,699,327 A * 12/1997 Boissenin ..... G04B 37/064 368/308
2003/0147312 A1* 8/2003 Hiranuma ..... G04C 3/001 368/308
2005/0207286 A1* 9/2005 Hiranuma ..... G04B 3/043 368/319

(Continued)

FOREIGN PATENT DOCUMENTS

JP S50-135156 U 11/1975
JP S58-189981 U 12/1983

(Continued)

OTHER PUBLICATIONS

Notice of Reasons for Refusal dated Oct. 27, 2020 received in Japanese Patent Application No. JP 2018-226331 together with an English language translation.

*Primary Examiner* — Edwin A. Leon
*Assistant Examiner* — Jason M Collins
(74) *Attorney, Agent, or Firm* — Scully, Scott, Murphy & Preser, P.C.

(57) ABSTRACT

A switch device including a base member provided with a stem insertion hole, an operation member which is slidably inserted into the stem insertion hole of the base member and has an engaging groove provided in an outer circumference surface, a stopper member having an engaging section which is arranged in the engaging groove of the operation member and moved along with sliding of the operation member, and a separation regulation section which prevents the engaging section from being separated from the engaging groove, in which a leading end portion of the engaging section is positionally regulated toward axial center of the operation member by the separation regulation section when the operation member is pulled toward the outside of the base member.

18 Claims, 9 Drawing Sheets

(56) References Cited

U.S. PATENT DOCUMENTS

| | | | | |
|---|---|---|---|---|
| 2005/0249051 | A1* | 11/2005 | Cogoli | G04B 3/04 368/319 |
| 2013/0155821 | A1* | 6/2013 | Tsuji | G04B 37/081 368/308 |
| 2014/0286146 | A1* | 9/2014 | Sakurazawa | G04B 3/043 368/320 |

FOREIGN PATENT DOCUMENTS

| | | | |
|---|---|---|---|
| JP | S59-42987 | U | 3/1984 |
| JP | S63-150387 | U | 10/1988 |
| JP | H03-130595 | U | 12/1991 |
| JP | 2005-274362 | A | 10/2005 |

* cited by examiner

SWITCH DEVICE AND TIMEPIECE

CROSS-REFERENCE TO RELATED APPLICATION

This application is based upon and claims the benefit of priority from the prior Japanese Patent Application No. 2018-226331, filed Dec. 3, 2018, the entire contents of which are incorporated herein by reference.

BACKGROUND

1. Technical Field

The technical field relates to a switch device for an electronic device such as a timepiece, and a timepiece equipped therewith.

2. Description of the Related Art

For example, a switch device for a timepiece is known in which an operation member called a winding stem is slidably and rotatably inserted into a stem insertion hole of a base member, an engaging section of a stopper member called a setting lever is arranged in an engaging groove of this operation member, and a rotation restriction section restricts the rotation of the stopper member when this stopper member is rotated along with the movement of the engaging section made in response to the sliding of the operation member, as shown in Japanese Patent Application Laid-Open (Kokai) Publication No. 2005-274362.

In the structure of this switch device, the engaging section of the stopper member arranged in the engaging groove of the operation member is held down by a hold down plate so that the engaging section of the stopper member is prevented from being separated from the engaging groove of the operation member.

However, in this switch device, when the operation member is forcefully pulled outward or is rotated while being forcefully pulled outward, the engaging section of the stopper member is lifted and separated from the engaging groove of the operation member against the hold down force of the hold down plate and the operation member is slipped out from the base member.

SUMMARY

In accordance with one embodiment, there is provided a switch device comprising: a base member provided with a stem insertion hole; an operation member which is slidably inserted into the stem insertion hole of the base member and has an engaging groove provided in an outer circumference surface; a stopper member having an engaging section which is arranged in the engaging groove of the operation member and moved along with sliding of the operation member; and a separation regulation section which prevents the engaging section from being separated from the engaging groove, wherein a leading end portion of the engaging section is positionally regulated toward axial center of the operation member by the separation regulation section when the operation member is pulled toward outside of the base member.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment applied in a wristwatch will hereinafter be described with reference to FIG. 1 to FIG. 9.

Figure 1:
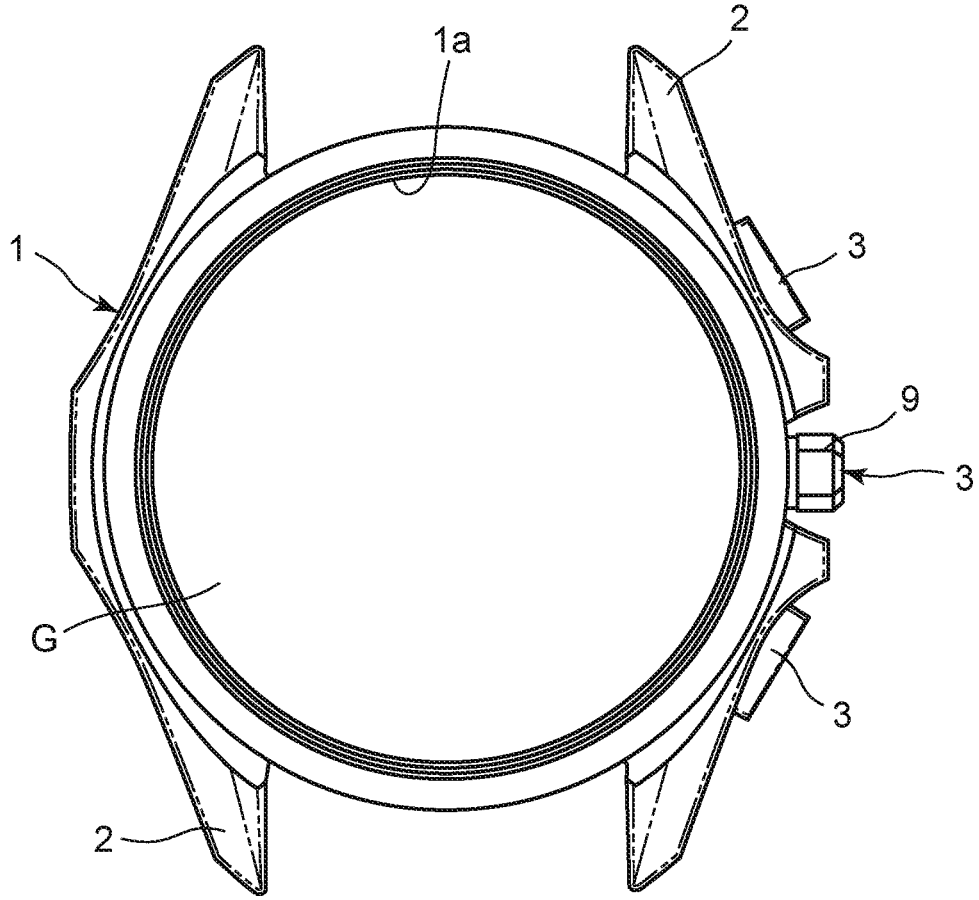
FIG. 1 is an enlarged front view showing an embodiment of a wristwatch.

This wristwatch has a wristwatch case 1, as shown in FIG. 1. On side portions on the twelve o'clock side and six o'clock side of the wristwatch case 1, band attachment sections 2 where a watch band (not shown) is attached are provided. Also, on side portions on the two a' clock side, three a' clock side and four o'clock side of the wristwatch case 1, switch devices 3 are provided, respectively.

On an opening section 1*a* on the front surface side of the wristwatch case 1, a watch glass G is provided, as shown in FIG. 1. Also, inside the wristwatch case 1, a timepiece module (not shown) is provided. This timepiece module has various components necessary for timepiece functions, such as a timepiece movement for driving pointers to indicate the time, a display section for electrooptically displaying information including time information, and a circuit section for electrically driving and controlling them.

Among the plurality of switch devices 3, the switch device 3 on the three o'clock side includes a base member 4, an operation member 6 slidably inserted into a stem insertion hole 5 of the base member 4, and a slide regulation mechanism 7 which regulates the slide position of the operation member 6, as shown in FIG. 2 to FIG. 7. The base member 4 is formed of hard synthetic resin.

The stem insertion hole 5 of the base member 4 is provided on a line connecting the three o'clock point of the wristwatch case 1 and the center of the wristwatch case 1, as shown in FIG. 2 to FIG. 7. Also, this stem insertion hole 5 has a small-diameter hole 5*a*, a first recess section 8*a*, a first medium-diameter hole 5*b*, a second recess section 8*b*, a second medium-diameter hole 5*c*, a first large-diameter hole 5*d*, a third recess section 8*c*, and a second large-diameter hole Se in the order from the center of the wristwatch case 1.

The operation member 6, which is called a winding stem and formed in a cylindrical shape, has a small-diameter section 6*a*, a non-circular section 6*b*, a large-diameter section 6*c*, a flange section 6*d*, and an attachment section 6*e* in the order from the inner end, as shown in FIG. 2 to FIG. 7. The small-diameter section 6*a* has a round bar shape and is slidably and rotatably inserted into the small-diameter hole 5*a* of the stem insertion hole 5 having a circular cross-section. The non-circular section 6*b* has a diameter larger than that of the small-diameter section 6*a*, and is a spline section formed in a shape having a non-circular cross-section, that is, a polygonal cross-section such as a quadrangular cross-section.

The non-circular section 6*b* is slidably and rotatably arranged in the first recess section 8*a*, the first medium-diameter hole 5*b*, the second recess section 8*b*, and the second medium-diameter hole 5*c* of the stem insertion hole 5, as shown in FIG. 2 to FIG. 7. The large-diameter section 6*c* of the operation member 6 is formed in a round bar shape whose circular cross-section has a diameter larger than that of the non-circular section 6*b*, and slidably and rotatably arranged in the first large-diameter hole 5*d*, the third recess section 8*c*, and the second large-diameter hole 5*e*, as shown in FIG. 2 to FIG. 7.

The flange section 6*d* of the operation member 6 has a diameter larger than those of the large-diameter section 6*c* and the second large-diameter hole 5*e*, and is arranged on the outer surface of the base member 4 such that it can be separated therefrom, as shown in FIG. 2 to FIG. 7. The attachment section 6*e* of the operation member 6 has a diameter substantially equal to that of the large-diameter section 6*c*, and projects toward the outside of the wristwatch case 1 from the base member 4 so that a winder 9 (refer to FIG. 1) can be attached to this projected portion.

Figure 3:
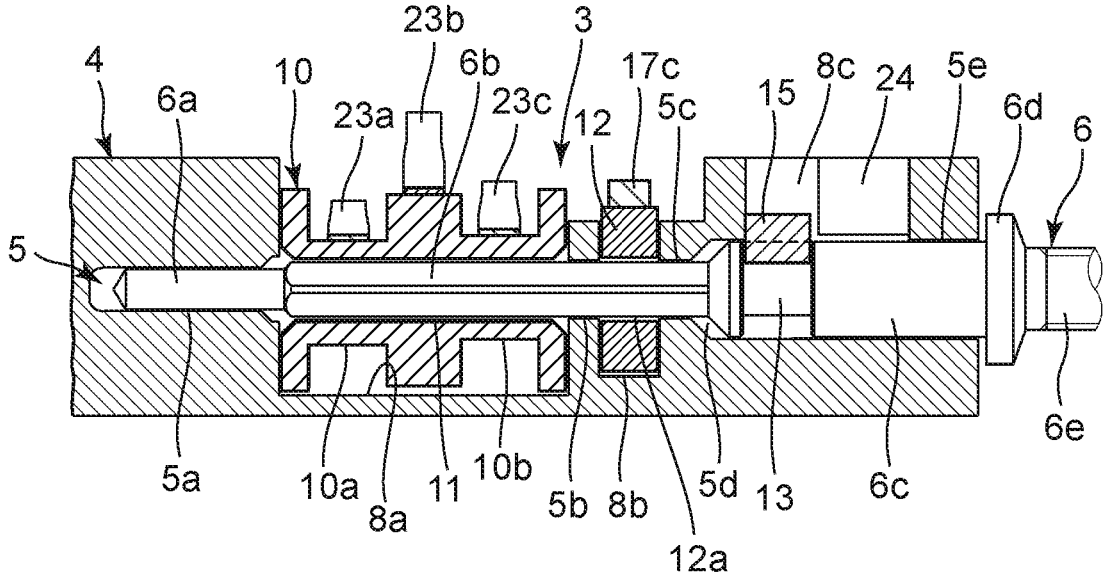
FIG. 3 is an enlarged sectional view of the main portion of the switch device taken along line A-A in FIG. 2.
Figure 6:
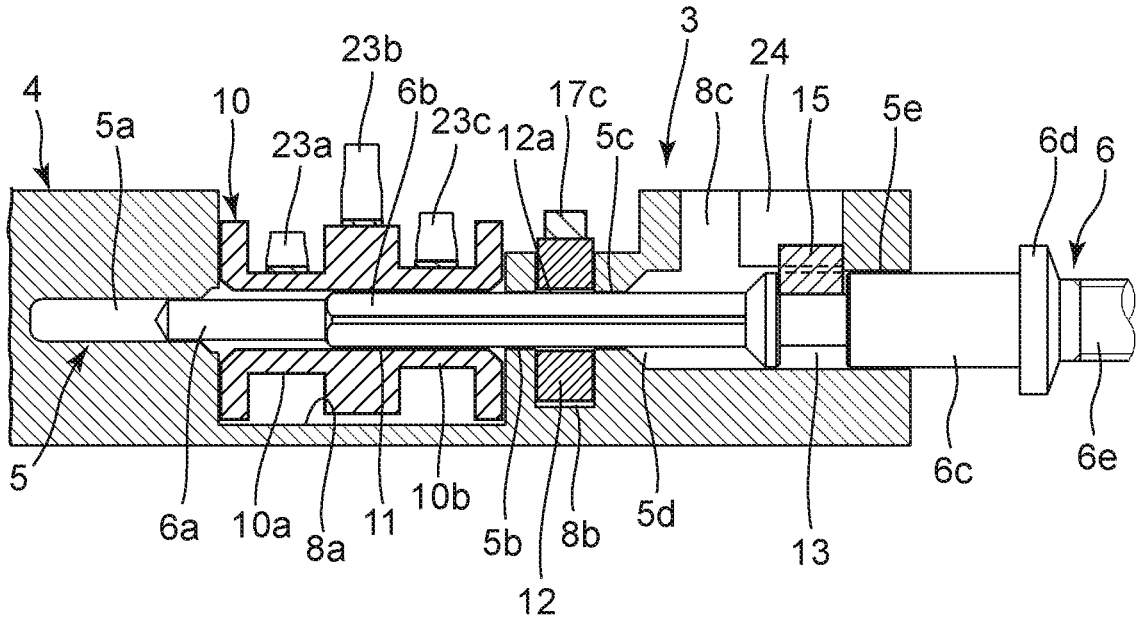
FIG. 6 is an enlarged sectional view of the main portion of the switch device taken along line C-C in FIG. 5.

The small-diameter hole 5*a* of the stem insertion hole 5 is formed such that its cross-section has a circular shape whose diameter is equal to the outer diameter of the small-diameter section 6*a* of the operation member 6, and the small-diameter section 6*a* is slidably and rotatably arranged in this small-diameter hole 5*a*, as shown in FIG. 3 and FIG. 6. The first and second medium-diameter holes 5*b* and 5*c* are each formed such that its cross-section has a circular shape whose diameter is equal to the outer diameter of the non-circular section 6*b* of the operation member 6, and the non-circular section 6*b* is slidably and rotatably arranged in these first and second medium-diameter holes 5*b* and 5*c*. The first and second large-diameter holes 5*d* and 5*e* are each formed such that its cross-section has a circular shape whose diameter is equal to the outer diameter of the large-diameter section 6*c* of the operation member 6, and the large-diameter section 6*c* is slidably and rotatably arranged in these first and second large-diameter holes 5*d* and 5*e*.

The first recess section 8*a* of the base member 4 has a recessed shape whose depth is greater than the outer diameter of the non-circular section 6*b* of the operation member 6, and a switch wheel 10 is arranged in this first recess section 8*a* such that it is exposed from the base member 4, as shown in FIG. 2, FIG. 3, FIG. 5 and FIG. 6. This switch wheel 10 is structured such that its cross-section has a non-circular shape, that is, a polygonal shape such as a quadrangular shape, and a stem hole 11 having a non-circular cross-section, that is, a polygonal cross-section such as a quadrangular cross-section as with the non-circular section 6*b* of the operation member 6 is provided in its axial center.

In the outer periphery of this switch wheel 10, a first annular groove 10*a* and a second annular groove 10*b* are provided, as shown in FIG. 2, FIG. 3, FIG. 5 and FIG. 6. Also, this switch wheel 10 is structured to be rotated together with the non-circular section 6*b* of the operation member 6 by the rotation of the operation member 6 with the non-circular section 6*b* being slidably inserted into the stem hole 11.

The second recess section 8*b* of the base member 4 has a recessed shape whose depth is greater than the outer diameter of the non-circular section 6*b* of the operation member 6, and a star wheel 12 is arranged in this second recess section 8*b* such that it is exposed from the base member 4, as shown in FIG. 2, FIG. 3, FIG. 5 and FIG. 6. This star wheel 12 is structured such that its outer periphery has a plurality of projections (not shown), and a stem hole 12*a* having a non-circular cross-section such as a quadrangular cross-section as with the non-circular section 6*b* of the operation member 6 is provided in its axial center. As a result, this star wheel 12 is structured to be rotated together with the non-circular section 6*b* of the operation member 6 by the rotation of the operation member 6 with the non-circular section 6*b* being slidably inserted into the stem hole 12*a*.

The third recess section 8*c* of the base member 4 is provided in a recessed shape at a position corresponding to the large-diameter section 6*c* of the operation member 6, and the large-diameter section 6*c* is slidably and rotatably arranged in this third recess section 8*c*, as shown in FIG. 2 to FIG. 7. Also, this third recess section 8*c* is structured to expose the large-diameter section 6*c* of the operation member 6 to the outside of the base member 4. In the large-diameter section 6*c* of the operation member 6, an annular engaging groove 13 is provided which is formed such that its inner diameter is substantially equal to the outer diameter of the non-circular section 6*b* and its length in the axial direction is as short as about one third of the length of the third recess section 8*c* in the axial direction.

This engaging groove 13 is provided on the inner end side of the large-diameter section 6*c* such that its inner end surface on the center side of the base member 4 is positioned corresponding to the inner end surface of the third recess section 8*c* when the operation member 6 is pressed into the stem insertion hole 5 of the base member 4, as shown in FIG. 2 to FIG. 7. As a result of this structure, a portion of the large-diameter section 6*c* where the engaging groove 13 is provided can be rotatably moved in the third recess section 8*c* in the base member 4 with the engaging groove 13 corresponding to the third recess section 8*c*.

The slide regulation mechanism 7 includes a stopper member 14 called a setting lever equipped with an engaging section 15 that is arranged in the engaging groove 13 of the operation member 6, a position regulation member 16 which regulates the rotation position of the stopper member 14, a hold down plate 17 which holds down the stopper member 14 so as to maintain a state where the engaging section 15 of the stopper member 14 has been arranged in the engaging groove 13 of the operation member 6, as shown in FIG. 2 to FIG. 7.

Figure 2:
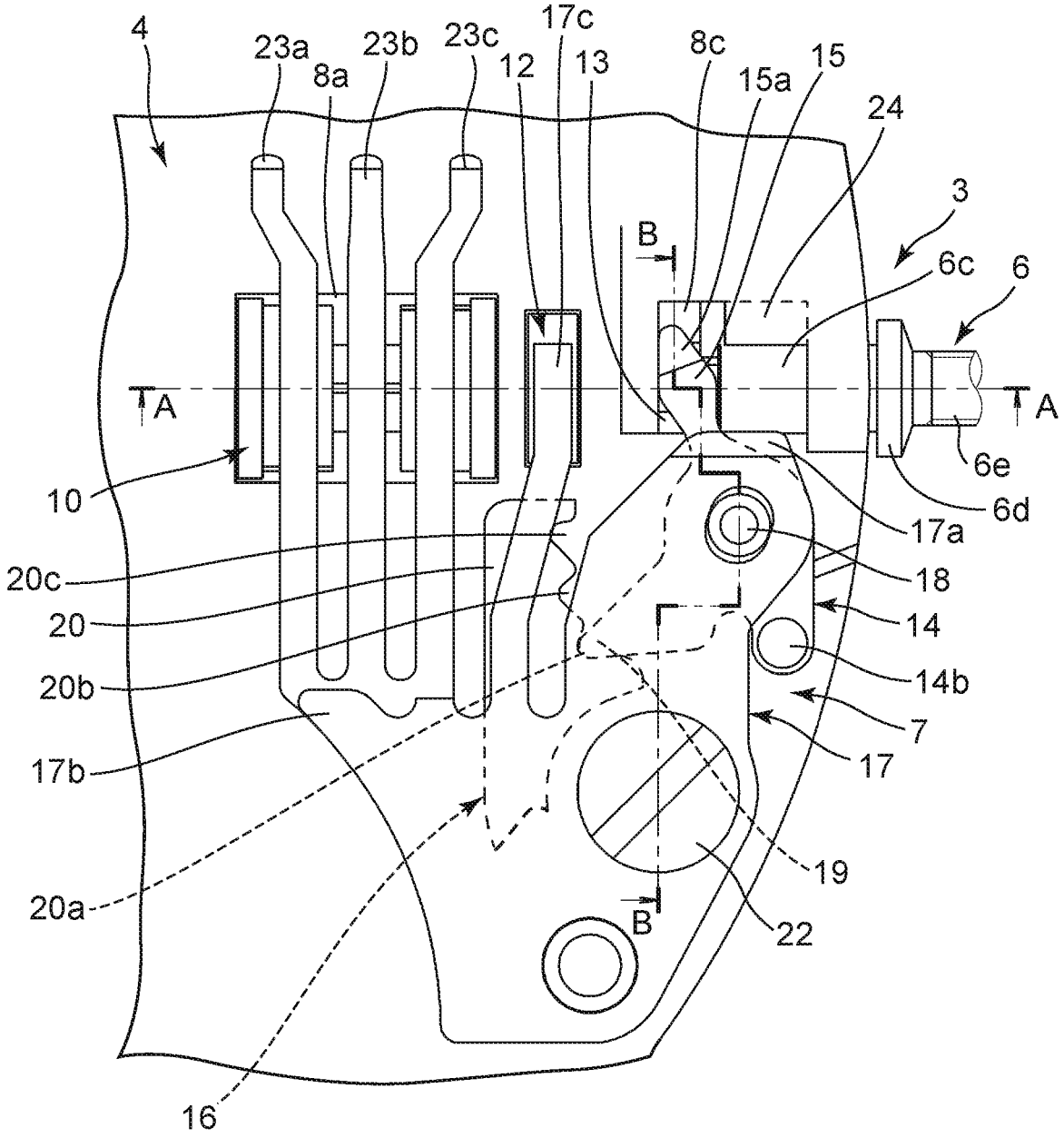
FIG. 2 is an enlarged back view showing a main portion of a switch device built into the wristwatch shown in FIG. 1.
Figure 4:
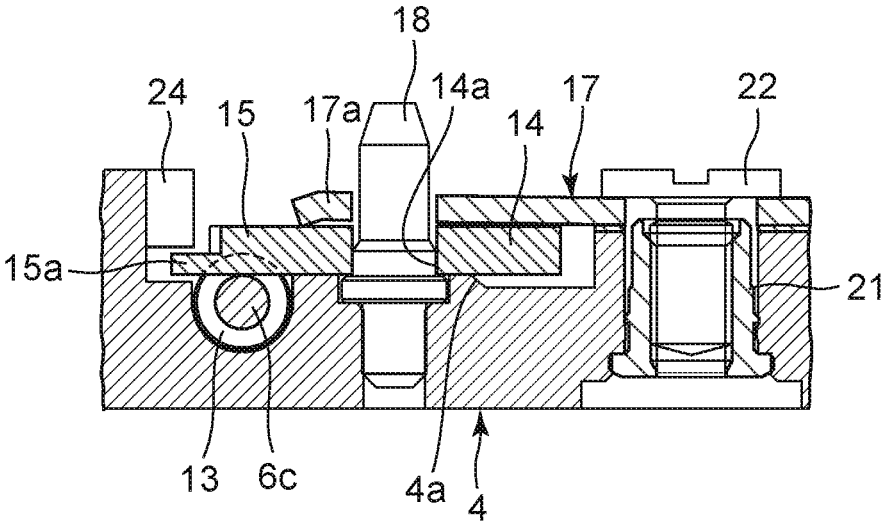
FIG. 4 is an enlarged sectional view of the main portion of the switch device taken along line B-B in FIG. 2.

The stopper member 14, which has a plate shape, is rotatably attached to a fixing shaft 18 provided on the base member 4 and, when the engaging section 15 is moved in response to the sliding of the operation member 6, rotated around the fixing shaft 18 along with the movement of the engaging section 15, as shown in FIG. 2 to FIG. 4. The engaging section 15 of the stopper member 14 projects from the outer periphery of the stopper member 14 toward the operation member 6, and this projecting end portion is arranged in and across the engaging groove 13 of the operation member 6 and protrudes toward the opposite side of the fixing shaft 18 of the stopper member 14.

More specifically, this end portion of the engaging section 15 has a substantially rhombus shape, and arranged in and across the engaging groove 13 of the operation member 6 in a direction intersecting with the axial direction of the operation member 6, as shown in FIG. 2 to FIG. 4. When the operation member 6 is slid, this engaging section 15 is moved together with the operation member 6 with its side portions being partially and continuously in contact with the inner side surfaces of the engaging groove 13.

Figure 5:
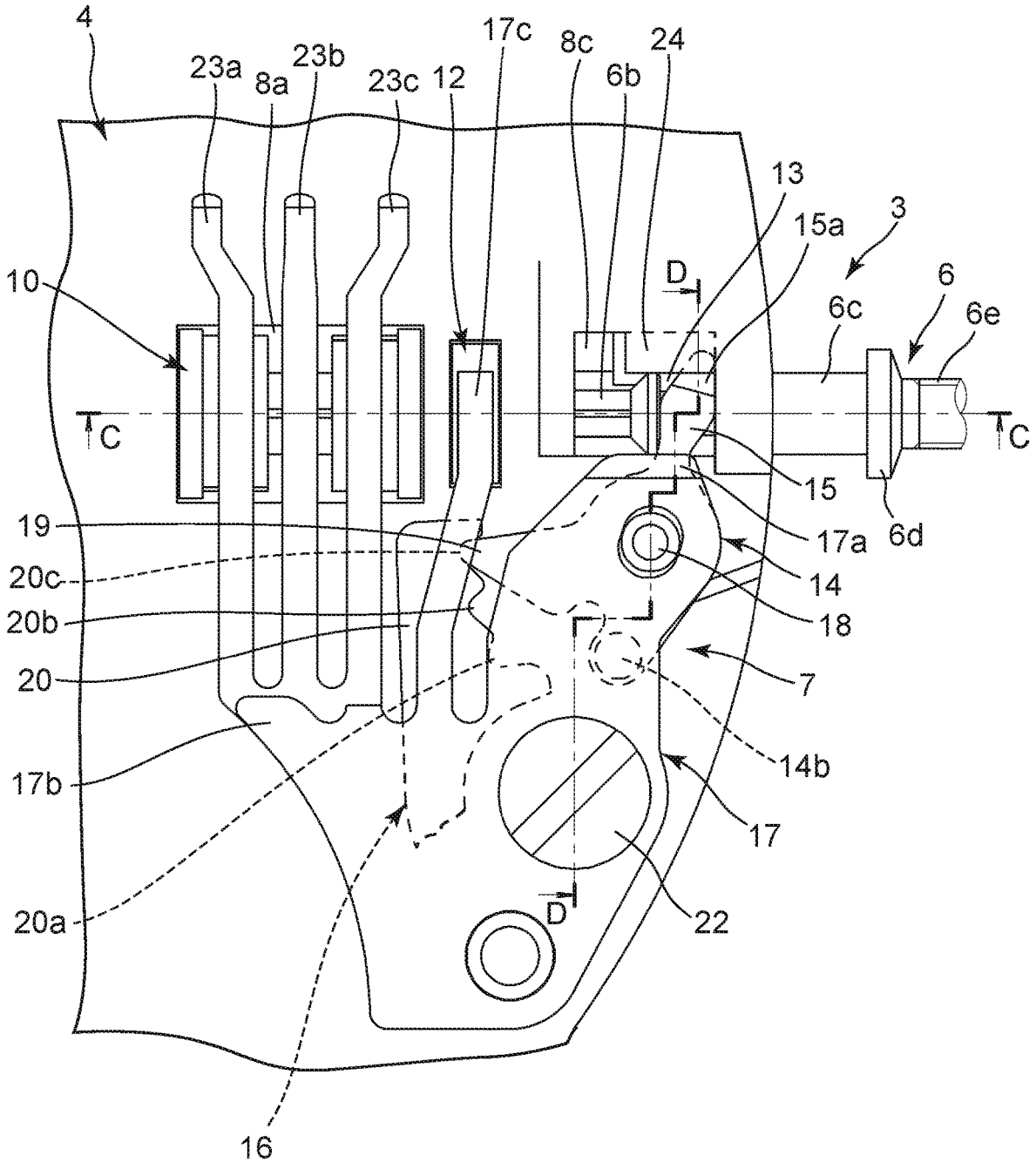
FIG. 5 is an enlarged back view showing a state where an operation member of the switch device shown in FIG. 2 has been pulled outward.

The position restriction member 16 of the slide regulation mechanism 7 is a plate spring member whose one end portion is fixed to the base member 4, as shown in FIG. 2 and FIG. 5. On the other end portion, that is, the leading end portion of the position restriction member 16, a rotation restriction section 20 is provided where a projection section 19 on the stopper member 14 is releasably caught in three stages. On this rotation restriction section 20, first to third catching concave sections 20*a* to 20*c* are provided which releasably catch the projection section 19 of the stopper member 14 by the spring force, that is, the flexural force of the position restriction member 16.

That is, the rotation restriction section 20 is structured such that, when the operation member 6 is pressed into the base member 4 and the stopper member 14 is rotated counterclockwise around the fixing shaft 18, the projection section 19 of the stopper member 14 is caught by the first catching concave section 20*a* by the spring force of the position restriction member 16 and the stopper member 14 is regulated to be at a first rotation position, whereby the operation member 6 is regulated to be at a first slide position, as shown in FIG. 2.

Also, the rotation restriction section 20 is structured such that, when the operation member 6 is pulled one step outward from the base member 4 and the stopper member 14 is rotated around the fixing shaft 18 in the clockwise direction in FIG. 2, the projection section 19 of the stopper member 14 is caught by the second catching concave section 20*b* by the spring force of the position restriction member 16 and the stopper member 14 is regulated to be at a second rotation position, whereby the operation member 6 is regulated to be at a second slide position.

Moreover, the rotation restriction section 20 is structured such that, when the operation member 6 is pulled two steps outward from the base member 4 and the stopper member 14 is further rotated clockwise around the fixing shaft 18, the projection section 19 of the stopper member 14 is caught by the third catching concave section 20*c* by the spring force of the position restriction member 16, and the stopper member 14 is regulated to be at a third rotation position, whereby the operation member 6 is regulated to be at a third slide position, as shown in FIG. 5.

The hold down plate 17 of the slide regulation mechanism 7 is attached to a cylindrical screw member 21 mounted in the base member 4 by a screw 22, as shown in FIG. 2, FIG. 4, FIG. 5 and FIG. 7. This hold down plate 17 includes a first hold down section 17*a* which holds down a base portion of the engaging section 15 of the stopper member 14 so as to maintain a state where the engaging section 15 has been arranged in the engaging groove 13 of the operation member 6, a second hold down section 17*b* which holds down a plurality of switch plates 23*a* to 23*c* described later, and a third hold down section 17*c* which is pressed against the outer periphery of the star wheel 12.

The plurality of switch plates 23*a* to 23*c* is each structured such that, in a state where its one end portion has been pressed against the base member 4 by the second hold down section 17*b* and fixed thereon, its other end portion is pressed against the outer peripheral surface of the switch wheel 10, as shown in FIG. 2, FIG. 3, FIG. 5 and FIG. 6. As a result, each switch plate 23*a* to 23*c* is structured such that the tip end of the other end portion is displaced in a direction to come in contact with the base member 4 or a direction to be away therefrom along with the rotation of the switch wheel 10 rotated by the rotation of the non-circular section 6*b* of the operation member 6, and thereby can come in contact with or be separated from a contact electrode (not shown) provided on the base member 4.

That is, among the plurality of switch plates 23*a* to 23*c*, the first switch plate 23*a* is structured such that the other end portion is pressed against the first annular groove 10*a* of the switch wheel 10, and the tip end of this other end portion is displaced in a direction to come in contact with the base member 4 or a direction to be away therefrom along with the rotation of the switch wheel 10 rotated by the rotation of the non-circular section 6*b* of the operation member 6, and thereby can come in contact with or be separated from a contact electrode (not shown) provided on the base member 4, as shown in FIG. 2, FIG. 3, FIG. 5 and FIG. 6.

Also, the second switch plate 23*b* is structured such that the other end portion is pressed against the outer peripheral surface of the switch wheel 10 between the first annular groove 10*a* and the second annular groove 10*b*, and the tip end of this other end portion is displaced in a direction to come in contact with the base member 4 or a direction to be away therefrom along with the rotation of the switch wheel 10 rotated by the rotation of the non-circular section 6*b* of the operation member 6, and thereby can come in contact with or be separated from a contact electrode (not shown) provided on the base member 4, as shown in FIG. 2, FIG. 3, FIG. 5 and FIG. 6.

Moreover, the third switch plate 23*c* is structured such that the other end portion is pressed against the second annular groove 10*b* of the switch wheel 10, and the tip end of this other end portion is displaced in a direction to come in contact with the base member 4 or a direction to be away therefrom along with the rotation of the switch wheel 10 rotated by the rotation of the non-circular section 6*b* of the operation member 6, and thereby can come in contact with or be separated from a contact electrode (not shown) provided on the base member 4, as shown in FIG. 2, FIG. 3, FIG. 5 and FIG. 6.

As a result, the plurality of switch plates 23*a* to 23*c* can detect the rotation speed and rotation direction of the operation member 6. Here, although not shown, the base member 4 includes a first switch which enters an ON state when the operation member 6 is pulled one step outward from the base member 4, and a second switch which enters an ON state when the operation member 6 is pulled two steps outward from the base member 4. These first and second switches are to change the operation mode of the timepiece module.

When one of these first and second switches is in an ON state, switch signals are provided to the timepiece module by the first to third switch plates 23*a* to 23*c* coming in contact with the contact electrodes, and the timepiece module is driven based on these switch signals. Conversely, when neither of these first and second switches is in an ON state, the timepiece module is not driven even when switch signals are provided to the timepiece module by the first to third switch plates 23*a* to 23*c* coming in contact with the contact electrodes.

The third hold down section 17*c* of the hold down plate 17 is a plate spring section formed by a portion of the hold down plate 17 being elongated, and its one end side is pressed against the outer periphery of star wheel 12. This third hold down section 17*c* gives a click feeling to the operation member 6 every time it surmounts one of the plurality of projections (not shown) on the outer periphery of the star wheel 12 rotated along with the rotation of the non-circular section 6*b* of the operation member 6, as shown in FIG. 2, FIG. 3, FIG. 5 and FIG. 6.

In the stopper member 14, a shaft hole 14*a* into which the fixing shaft 18 is inserted is provided, and this shaft hole 14*a* has a long hole shape whose outer diameter is slightly larger than that of the fixing shaft. 18 along the direction perpendicular to the axial direction of the operation member 6, as shown in FIG. 2 to FIG. 4, FIG. 8, and FIG. 9. Also, on this stopper member 14, a pressing operation section 14*b* for inclining the stopper member 14 is provided. When subjected to a pressing operation, this pressing operation section 14*b* inclines the stopper member 14 with a fulcrum section 4*a* around the fixing shaft 18 in the base member 4 as a fulcrum, and thereby lifts the engaging section 15 of the stopper member 14.

Figure 8:
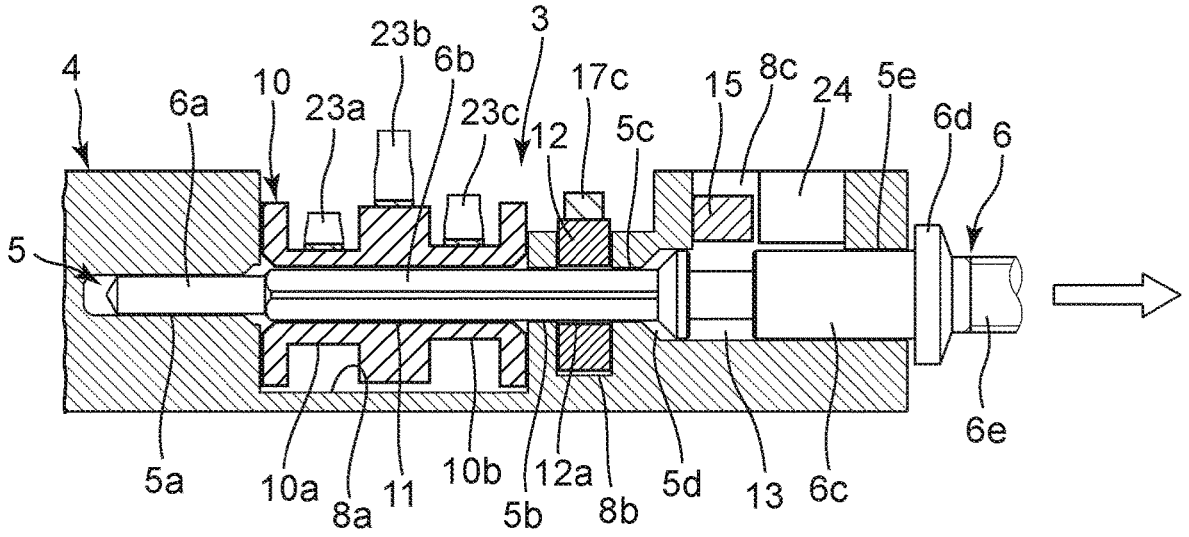
FIG. 8 is an enlarged sectional view of the main portion of the switch device shown in FIG. 3, in which a press operation section of a stopper member has been pressed and the stopper member has been inclined.
Figure 9:
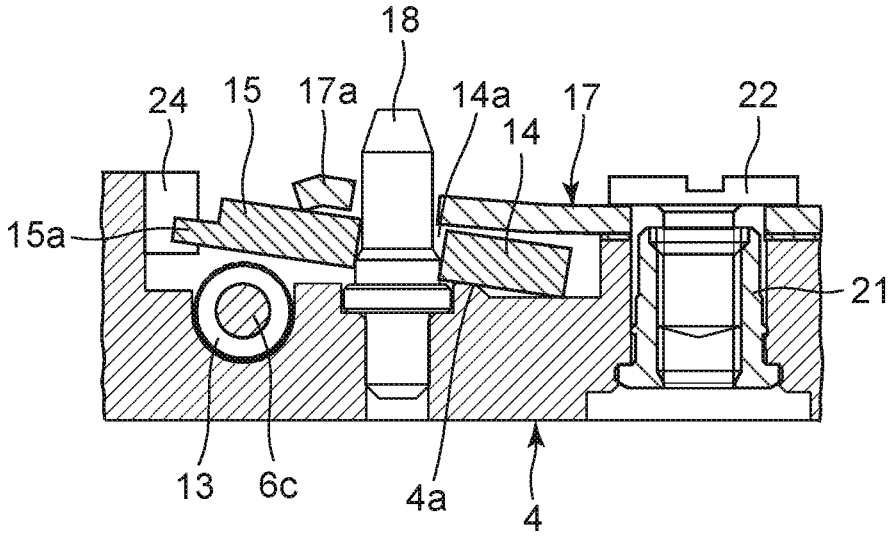
FIG. 9 is an enlarged sectional view of the main portion of the switch device shown in FIG. 4, in which an engaging section of the stopper member has been separated from an engaging groove of the operation member along with the inclination of the stopper member.

That is, this pressing operation section 14*b* is structured to be exposed at the side of the hold down plate 17 when the operation member 6 is pressed and the projection section 19 of the stopper member 14 is caught in the first catching concave section 20*a* of the position regulation member 16, as shown in FIG. 2, FIG. 8 and FIG. 9. As a result, the stopper member 14 is structured such that, when the pressing operation section 14*b* located at the side of the hold down plate 17 is subjected to a pressing operation, this stopper member 14 is inclined with the fulcrum section 4*a* of the base member 4 as a fulcrum, whereby the engaging section 15 of the stopper member 14 is lifted and separated from the engaging groove 13 of the operation member 6.

On the third recess section 8*c* of the base member 4, a separation regulation section 24 is provided which prevents the engaging section 15 of the stopper member 14 in the slide regulation mechanism 7 from being separated from the engaging groove 13 of the operation member 6 when the operation member 6 is pulled toward the outside of the base member 4, as shown in FIG. 2 to FIG. 7.

This separation regulation section 24 is a brim section which slidably holds down the engaging section 15 of the stopper member 14, and provided such that a leading end portion of the engaging section 15 protruding from the inside of the engaging groove 13 is positioned under this separation regulation section 24 when the operation member 6 is pulled toward the outside of the base member 4, as shown in FIG. 2 to FIG. 7. That is, the position of the leading end portion of the engaging section 15 is regulated toward the axial center of the operation member 6 by the separation regulation section 24 when the operation member 6 is pulled toward the outside of the base member 4.

More specifically, the separation regulation section 24 is integrally formed on the inner surface of the third recess section 8*c* of the base member 4 in a manner to correspond to the leading end portion of the engaging section 15 when the operation member 6 is pulled toward the outside of the base member 4, as shown in FIG. 2 to FIG. 7. In other words, the separation regulation section 24 is integrally formed on the inner surface of the third recess section 8*c* in a manner to correspond to the engaging groove 13 of the operation member 6 when the operation member 6 is pulled toward the outside of the base member 4.

Also, the separation regulation section 24 is structured to release the state where the leading end portion of the engaging section 15 is under this separation regulation section 24 when the operation member 6 is pressed toward the inside of the base member 4, so that the engaging section 15 can be separated from the engaging groove 13, as shown in FIG. 2 to FIG. 7. That is, the separation regulation section 24 is provided on a potion of the inner surface of the third recess section 8*c* corresponding to the engaging groove 13 of the operation member 6, or in other words, a portion of the inner surface excluding an area corresponding to the leading end portion of the engaging section 15 when the operation member 6 is pressed toward the inside of the base member 4.

Moreover, the separation regulation section 24 is provided projecting from the inner surface of the third recess section 8*c* such that its undersurface corresponds to the upper outer surface of the large-diameter section 6*c* of the operation member 6 located on the side opposite to the lower surface side of the engaging section 15 which is pressed against the inner circumference surface of the engaging groove 13 of the operation member 6, and this separation regulation section 24 is located close to the side outer surface of the large-diameter section 6*c* of the operation member 6 on the side where the leading end portion of the engaging section 15 is positioned, as shown in FIG. 2 to FIG. 7.

On the other hand, the engaging section 15 of the stopper member 14 arranged in the engaging groove 13 of the operation member 6 protrudes toward the separation regulation section 24 side such that its leading end portion located on the opposite side of the pressing operation section 14*b* crosses the inside of the engaging groove 13 of the operation member 6, as shown in FIG. 2 to FIG. This protruding end portion of the engaging section 15 corresponds to the separation regulation section 24 in the state where the operation member 6 has been pulled toward the outside of the base member 4. In this leading end portion of the engaging section 15, a notch section 15*a* is provided corresponding to the separation regulation section 24.

Figure 7:
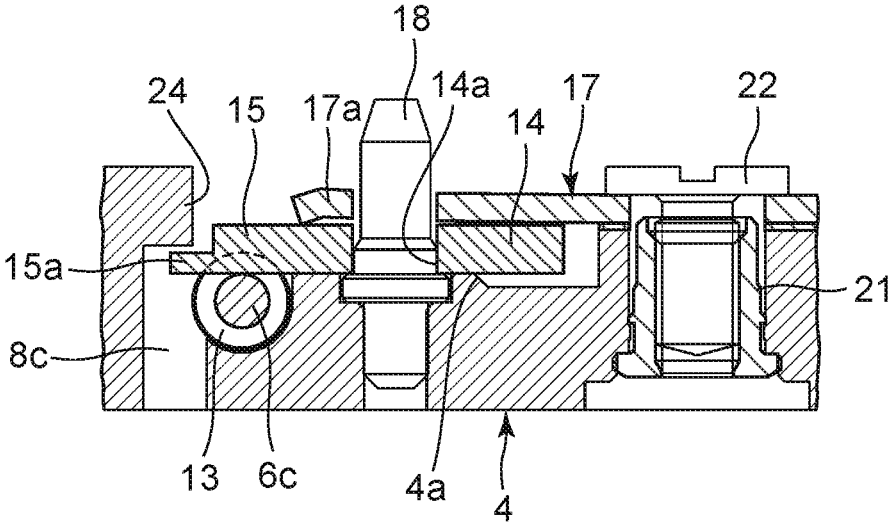
FIG. 7 is an enlarged sectional view of the main portion of the switch device taken along line D-D in FIG. 5.

The separation regulation section 24 is structured such that, when the operation member 6 is pulled toward the outside of the base member 4 and regulated to be at the second slide position or the third slide position by the slide regulation mechanism 7, the notch section 15*a* of the leading end portion of the engaging section 15 is positioned under the separation regulation section 24, whereby the engaging section 15 is prevented from being separated from the inside of the engaging groove 13 of the operation member, as shown in FIG. 5 to FIG. 7.

Also, the separation regulation section 24 is structured such that, when the operation member 6 is pressed toward the inside of the base member 4 and regulated to be at the first slide position by the slide regulation mechanism 7, the notch section 15*a* of the leading end portion of the engaging section 15 is separated from the separation regulation section 24 and released from regulation by the separation regulation section 24, whereby the engaging section 15 can be separated from the inside of the engaging groove 13 of the operation member, as shown in FIG. 2 to FIG. 4, FIG. 8 and FIG. 9.

That is, the stopper member 14 of the slide regulation mechanism 7 is structured such that, when the pressing operation section 14*b* is subjected to a pressing operation with the operation member 6 being pressed and regulated to be at the first slide position and the engaging section 15 being released from regulation by the separation regulation section 24, the stopper member 14 is inclined with the fulcrum section 4*a* of the base member 4 as a fulcrum and the engaging section 15 is lifted, as shown in FIG. 2 to FIG. 4, FIG. 8 and FIG. 9.

That is, the stopper member 14 is structured such that, when it is inclined with the fulcrum section 4*a* of the base member 4 as a fulcrum, the engaging section 15 is lifted without being blocked by the separation regulation section 24 and thereby separated from the engaging groove 13 of the operation member 6, as shown in FIG. 2 to FIG. 4, FIG. 8 and FIG. 9. As a result, the operation member 6 can be pulled out of and detached from the stem insertion hole 5 of the base member 4.

Next, the mechanism of the switch device 3 of this wristwatch is described.

Normally, in this switch device 3, the operation member 6 is pressed into the base member 4 and regulated to be at the first slide position by the slide regulation mechanism 7.

Here, the engaging section 15 of the stopper member 14 arranged in the engaging groove 13 of the operation member 6 is moved with the operation member 6 toward the inside of the base member 4, and the stopper member 14 is rotated counter clockwise around the fixing shaft 18 along with this movement of the engaging section 15. With this rotation of the stopper member 14, the projection section 19 of the stopper member 14 is moved against the spring force of the position regulation member 16 and caught by the first catching concave section 20*a*. As a result, the stopper member 14 is regulated to be at the first rotation position and the operation member 6 is regulated to be at the first slide position.

At this point, the first switch and the second switch are not in their ON states. Accordingly, even when the switch wheel 10 is rotated by the operation member 6 being rotated, and switch signals are outputted by the first to third switch plates 23*a* to 23*c* coming in contact with the contact electrodes (not shown) of the base member 4 along with the rotation of the switch wheel 10, the timepiece module (not shown) is not driven by these switch signals and operations such as time adjustment is not performed.

When the timepiece module (not shown) is to be driven by the operation of the switch device 3 so as to perform time adjustment or the like, the operation member 6 is pulled one step toward the outside of the base member 4. As a result, the engaging section 15 of the stopper member 14 arranged in the engaging groove 13 of the operation member 6 is moved toward the outside of the base member 4 together with the operation member 6, and the stopper member 14 is rotated around the fixing shaft 18 in the clockwise direction of FIG. 2 along with the movement of the engaging section 15.

Accordingly, the projection section 19 of the stopper member 14 is moved against the spring force of the position regulation member 16 and caught by the second catching concave section 20*b*, whereby the stopper member 14 is regulated to be at the second rotation position and the operation member 6 is regulated to be at the second slide position. Here, the first switch (not shown) is turned on, which enables the driving of the timepiece module in the first mode.

Also, when the operation member 6 is pulled two steps toward the outside of the base member 4, the engaging section 15 of the stopper member 14 arranged in the engaging groove 13 of the operation member 6 is further moved toward the outside of the base member 4 together with the operation member 6, and the stopper member 14 is rotated clockwise around the fixing shaft 18 along with the movement of the engaging section 15, as shown in FIG. 5.

As a result, the projection section 19 of the stopper member 14 is moved against the spring force of the position regulation member 16 and caught by the third catching concave section 20*c*, whereby the stopper member 14 is regulated to be at the third rotation position and the operation member 6 is regulated to be at the third slide position. Here, the second switch (not shown) is turned on and the current operation mode is switched to the second mode, which enables the driving of the timepiece module in the second mode.

In this state where the operation member 6 has been pulled toward the outside of the base member 4 and regulated to be at the second slide position or the third slide position, when the operation member 6 is rotated, the switch wheel 10 is rotated with the non-circular section 6*b* of the operation member 6. As a result, each end portion of the first to third switch plates 23*a* to 23*c* is displaced in a direction to come in contact with the base member 4 or a direction to be away therefrom along with the rotation of the switch wheel 10, and comes in contact with or separates from the contact electrodes (not shown) of the base member 4.

Accordingly, the rotation speed and direction of the operation member 6 are detected and, based on the detected signals, the timepiece module performs an operation such as time adjustment in an operation mode selected by the first switch or the second switch. Also, here, the star wheel 12 is rotated together with the non-circular section 6*b* of the operation member 6, and the third hold down section 17*c* of the hold down plate 17 pressed against the outer periphery of the star wheel 12 gives a click feeling to the operation member 6 every time it surmounts one of the plurality of projections (not shown) on the outer periphery of the star wheel 12.

Also, in this state where the operation member 6 has been regulated to be at the second slide position or the third slide position, the notch section 15*a* in the leading end portion of the engaging section 15 of the stopper member 14 arranged in the engaging groove 13 of the operation member 6 is under the separation regulation section 24 provided on the inside of the third recess section 8*c* of the base member 4. Here, since the base portion of the engaging section 15 of the stopper member 14 has been held down by the hold down plate 17 and the engaging section 15 has been pressed against the engaging groove 13, the leading end portion of the engaging section 15 is smoothly positioned under the separation regulation section 24 without coming in contact with the separation regulation section 24.

Accordingly, even if the operation member 6 is forcefully pulled or is rotated while being forcefully pulled, the engaging section 15 of the stopper member 14 is not lifted and does not come out of the engaging groove 13 of the operation member 6 since the notch section 15*a* in the leading end portion of the engaging section 15 of the stopper member 14 has been held down by the separation regulation section 24. As a result, the operation member 6 is not unintentionally slipped out from the stem insertion hole 5 of the base member 4.

Also, when the operation member 6 is to be detached from the stem insertion hole 5 of the base member 4 for maintenance, the operation member 6 is pressed into the base member 4 and regulated to be at the first slide position. Here, the notch section 15*a* in the leading end portion of the engaging section 15 of the stopper member 14 is moved away from the separation regulation section 24 and released from being positioned under the separation regulation section 24, which allows the engaging section 15 to be separated from the engaging groove 13 of the operation member 6, as shown in FIG. 2.

Also, here, the stopper member 14 is regulated to be at the first rotation position, and the pressing operation section 14*b* of the stopper member 14 is exposed at the side of the hold down plate 17. When this exposed pressing operation section 14*b* is subjected to a pressing operation, the stopper member 14 is inclined with the fulcrum section 4*a* of the base member 4 as a fulcrum, and the engaging section 15 of the stopper member 14 is separated from the engaging groove 13 without being blocked by the separation regulation section 24. As a result, the operation member 6 can be pulled out of and detached from the stem insertion hole 5 of the base member 4.

As described above, the switch device 3 of this wristwatch includes the operation member 6 which is slidably and rotatably inserted into the stem insertion hole 5 of the base member 4 and has the engaging groove 13 annularly provided in the outer circumference surface thereof, the stopper member 14 having the engaging section 15 which is arranged across the inside of the engaging groove 13 of the operation member 6 and moved along with the sliding of the operation member 6, and the separation regulation section 24 which prevents the engaging section 15 from being separated from the engaging groove 13, and the leading end portion of the engaging section 15 is positionally regulated toward the axial center of the operation member 6 by the separation regulation section 24 when the operation member 6 is pulled toward the outside of the base member 4. As a result of this structure, the operation member 6 can be prevented from being unintentionally slipped out from the base member 4.

That is, in the switch device 3 of this wristwatch, when the operation member 6 is pulled toward the outside of the base member 4, the leading end portion of the engaging section 15 arranged across the inside of the engaging groove 13 of the operation member 6 is positionally regulated toward the axial center of the operation member 6 by the separation regulation section 24, whereby the engaging section 15 is reliably prevented from being separated from the engaging groove 13. Accordingly, even if the operation member 6 is forcefully pulled or is rotated while being forcefully pulled, the engaging section 15 is not lifted and does not come out of the engaging groove 13, whereby the operation member 6 is not unintentionally slipped out from the stem insertion hole 5 of the base member 4.

That is, in this switch device 3, when the operation member 6 is pulled toward the outside of the base member 4, the leading end portion of the engaging section 15 arranged across the inside of the engaging groove 13 is positioned under the separation regulation section 24, whereby the engaging section 15 is reliably prevented from being separated from the engaging groove 13. Accordingly, even if the operation member 6 is forcefully pulled or is rotated while being forcefully pulled, the engaging section 15 is not lifted and does not come out of the engaging groove 13, whereby the operation member 6 is prevented from being unintentionally slipped out from the stem insertion hole 5 of the base member 4.

Also, in the switch device 3 of this wristwatch, when the operation member 6 is pressed into the base member 4, the leading end portion of the engaging section 15 is released from being positioned under the separation regulation section 24, which allows the engaging section 15 to be separated from the engaging groove 13. As a result of this structure, when the operation member 6 is pressed into the base member 4, the engaging section 15 can be separated from the engaging groove 13, whereby the operation member 6 can be easily pulled out from the stem insertion hole 5 of base member 4. That is, the operation member 6 can be favorably detached.

Moreover, in the switch device 3 of this wristwatch, the separation regulation section 24 is integrally formed on the inner surface of the third recess section 8*c* of the base member 4 in a manner to correspond to the leading end portion of the engaging section 15 when the operation member 6 is pulled toward the outside of the base member 4. As a result of this structure, when the operation member 6 is pulled toward the outside of the base member 4, the leading end portion of the engaging section 15 can be unfailingly and favorably positioned under the separation regulation section 24.

Furthermore, by the structure where the separation regulation section 24 is integrally formed on the inner surface of the third recess section 8*c* of the base member 4, separate parts are not necessary and therefore the number of the parts is not increased even though the separation regulation section is included. Accordingly, the assembly work can be simplified, and cost reduction can be achieved.

Still further, in the switch device 3 of this wristwatch, the separation regulation section 24 is provided projecting such that, it corresponds to the upper outer surface of the operation member 6 located on the side opposite to the lower surface side of the engaging section 15 which is pressed against the inner circumference surface of the engaging groove 13 of the operation member 6, and is located close to the side outer surface of the operation member 6 on the side where the leading end portion of the engaging section 15 is positioned. As a result of this structure, when the operation member 6 is pulled toward the outside of the base member 4, the leading end portion of the engaging section 15 can be unfailingly and favorably positioned under the separation regulation section 24.

Yet still further, the leading end portion of the engaging section 15 protrudes across the inside of the engaging groove 13 of the operation member 6, and the notch section 15*a* is in this leading end portion of the engaging section 15 while corresponding to the separation regulation section 24. By this notch section 15*a*, the leading end portion of the engaging section 15 is thin. Accordingly, even though the separation regulation section 24 is provided on the base member 4, the base member 4 as a whole is thin, which makes the switch device thinner and consequently makes the entire wristwatch thinner.

Yet still further, in the switch device 3 of this wristwatch, the slide position of the operation member 6 is regulated at the plurality of stages by the slide regulation mechanism 7. Accordingly, by one switch device 3, many switch functions can be actualized.

That is, the slide regulation mechanism 7 includes the stopper member 14 provided with the engaging section 15, and the position regulation member 16 which regulates the rotation position of the stopper member 14 by the first to third catching concave sections 20*a* to 20*c*. By these first to third catching concave sections 20*a* to 20*c* of the position regulation member 16, the stopper member 14 can be regulated to be at the first to third rotation positions, whereby the operation member 6 can be unfailingly regulated to be at the first to third slide positions.

In the above-described embodiment, the separation regulation section 24 is integrally provided on the inner surface of the third recess section 8*c* of the base member 4. However, the present invention is not limited thereto and a structure may be adopted in which the separation regulation section 24 is formed using a separate part, and this separation regulation section constituted by the separate part is attached to the base member 4 and arranged in the third recess section 8*c*.

Also, in the above-described embodiment, the switch device 3 is structured such that the operation member 6 is slid at the three stages. However, the present invention is not limited thereto and a structure may be adopted in which the operation member 6 is slid at two stages or slid at four or more stages.

Moreover, in the above-described embodiment, the switch device 3 located on the three o'clock side of the wristwatch case 1 has been described. However, the present invention is not limited thereto and can be applied to the switch device 3 on the two o'clock side or the switch device 3 on the four o'clock side.

Furthermore, in the above-described embodiment, the present invention has been applied in a wristwatch. However, the present invention is not necessarily required to be applied in a wristwatch. For example, the present invention is applicable to various types of timepieces such as a travel watch, an alarm clock, a table clock and a wall clock. Moreover, the present invention is not necessarily required to be applied in timepieces, and can be applied in electronic devices such as a portable telephone and a portable terminal device.

While the present invention has been described with reference to the preferred embodiments, it is intended that the invention be not limited by any of the details of the description therein but includes all the embodiments which fall within the scope of the appended claims

What is claimed is:

1. A switch device comprising:

a base member provided with a stem insertion hole;

an operation member which is slidably inserted into the stem insertion hole of the base member and has an engaging groove provided in an outer circumference surface;

a stopper member having an engaging section which is arranged in the engaging groove of the operation member and moved along with sliding of the operation member; and a separation regulation section which prevents the engaging section from being separated from the engaging groove, wherein a leading end portion of the engaging section is positionally regulated toward axial center of the operation member by the separation regulation section when the operation member is pulled toward outside of the base member, and wherein the separation regulation section releases the leading end portion of the engaging section from being positioned under the separation regulation section when the operation member is pressed into the base member, and thereby allows the engaging section to be separated from the engaging groove.

2. The switch device according to claim 1, wherein the separation regulation section is provided on the base member in a manner to correspond to the leading end portion of the engaging section when the operation member is pulled toward the outside of the base member.

3. The switch device according to claim 1, wherein the separation regulation section is provided projecting such that the separation regulation section (i) corresponds to an outer surface of the operation member located on a side opposite to a surface of the engaging section which is pressed against an inner circumference surface of the engaging groove, and (ii) is located close to an outer surface of the operation member on a side where the leading end portion of the engaging section is positioned.

4. The switch device according to claim 1, wherein the leading end portion of the engaging section has a notch section provided corresponding to the separation regulation section.

5. The switch device according to claim 1, wherein the operation member is rotatable.

6. A timepiece comprising the switch device according to claim 1.

7. A switch device comprising:

a base member provided with a stem insertion hole;

an operation member which is slidably inserted into the stem insertion hole of the base member and has an engaging groove provided in an outer circumference surface;

a stopper member having an engaging section which is arranged in the engaging groove of the operation member and moved along with sliding of the operation member; and a separation regulation section which prevents the engaging section from being separated from the engaging groove, wherein a leading end portion of the engaging section is positionally regulated toward axial center of the operation member by the separation regulation section when the operation member is pulled toward outside of the base member, and wherein the separation regulation section is provided on the base member in a manner to correspond to the leading end portion of the engaging section when the operation member is pulled toward the outside of the base member.

8. The switch device according to claim 7, wherein the separation regulation section releases the leading end portion of the engaging section from being positioned under the separation regulation section when the operation member is pressed into the base member, and thereby allows the engaging section to be separated from the engaging groove.

9. The switch device according to claim 7, wherein the separation regulation section is provided projecting such that the separation regulation section (i) corresponds to an outer surface of the operation member located on a side opposite to a surface of the engaging section which is pressed against an inner circumference surface of the engaging groove, and (ii) is located close to an outer surface of the operation member on a side where the leading end portion of the engaging section is positioned.

10. The switch device according to claim 7, wherein the leading end portion of the engaging section has a notch section provided corresponding to the separation regulation section.

11. The switch device according to claim 7, wherein the operation member is rotatable.

12. A timepiece comprising the switch device according to claim 7.

13. A switch device comprising:

a base member provided with a stem insertion hole;

an operation member which is slidably inserted into the stem insertion hole of the base member and has an engaging groove provided in an outer circumference surface;

a stopper member having an engaging section which is arranged in the engaging groove of the operation member and moved along with sliding of the operation member; and a separation regulation section which prevents the engaging section from being separated from the engaging groove, wherein a leading end portion of the engaging section is positionally regulated toward axial center of the operation member by the separation regulation section when the operation member is pulled toward outside of the base member, and wherein the leading end portion of the engaging section has a notch section provided corresponding to the separation regulation section.

14. The switch device according to claim 13, wherein the separation regulation section releases the leading end portion of the engaging section from being positioned under the separation regulation section when the operation member is pressed into the base member, and thereby allows the engaging section to be separated from the engaging groove.

15. The switch device according to claim 13, wherein the separation regulation section is provided on the base member in a manner to correspond to the leading end portion of the engaging section when the operation member is pulled toward the outside of the base member.

16. The switch device according to claim 13, wherein the separation regulation section is provided projecting such that the separation regulation section (i) corresponds to an outer surface of the operation member located on a side opposite to a surface of the engaging section which is pressed against an inner circumference surface of the engaging groove, and (ii) is located close to an outer surface of the operation member on a side where the leading end portion of the engaging section is positioned.

17. The switch device according to claim 13, wherein the operation member is rotatable.

18. A timepiece comprising the switch device according to claim 13.

* * * * *